United States Patent [19]

Fisher

[11] 4,449,323

[45] May 22, 1984

[54] ADJUSTABLE SPINNING TOY VEHICLE

[75] Inventor: David R. Fisher, Rancho Palos Verdes, Calif.

[73] Assignee: Zee Toys, Inc., Long Beach, Calif.

[21] Appl. No.: 380,218

[22] Filed: May 20, 1982

[51] Int. Cl.[3] ..... A63H 17/26; A63H 17/38

[52] U.S. Cl. ..... 46/211; 46/202

[58] Field of Search ..... 46/211, 206, 201, 213, 46/262, 202

[56] References Cited

U.S. PATENT DOCUMENTS

| | | | |
|---|---|---|---|
| 1,682,764 | 9/1928 | Mohr | 46/211 |
| 2,517,084 | 8/1950 | Carver | 46/206 |
| 2,567,453 | 9/1951 | Swenson et al. | 46/206 |
| 2,698,497 | 1/1955 | Müller | 46/206 |
| 3,344,553 | 10/1967 | Taggart | 46/206 |
| 3,474,564 | 10/1969 | Perryman | 46/201 |
| 4,329,810 | 5/1982 | Terui | 46/202 |

OTHER PUBLICATIONS

"Stunt Riders" sold by LJN New York, N.Y. Toy Package Back.

*Primary Examiner*—Robert A. Hafer
*Assistant Examiner*—Paul S. Polakowski
*Attorney, Agent, or Firm*—Fulwider, Patton, Rieber, Lee & Utecht

[57] ABSTRACT

A toy vehicle is provided including a counterbalance weight and a support member which can cause the vehicle to spin while performing a wheelstand. The counterbalance weight can be positioned to provide a downwardly directed force which, together with the torque on the rear wheels, causes the front wheels to raise off the ground as the vehicle moves forward. The support member includes a pair of skids which can be positioned to engage the ground while the vehicle is performing a wheelstand to cause it to spin substantially in circles. Alternatively, the counterbalance weight can be positioned so that an insufficient counterbalance force exists to raise the front wheels off the ground as the vehicle moves forward.

9 Claims, 6 Drawing Figures

ADJUSTABLE SPINNING TOY VEHICLE

SUMMARY OF THE INVENTION

The present invention resides in a toy vehicle which can be caused to spin while performing a wheelstand with its front wheels off the ground. More specifically, an adjustable counterbalance weight is positioned rearward of the vehicle's rear wheels to provide a downwardly directed counterbalance force which, in conjunction with the torque on the rear wheels produced by the vehicle's motor, causes the front wheels to raise off the ground as the vehicle moves forward. A support member is provided which can be selectively positioned to engage the ground at a point located adjacent to and rearward of either rear wheel while the vehicle performs a wheelstand. The contact between the ground and the support member causes the vehicle to spin substantially in circles with the direction of rotation of the spin depending upon the position preselected for the support member.

In one embodiment, the support member is rigidly attached to the counterbalance weight, and includes a pair of laterally spaced-apart skids which engage the ground. The support member is attached to the vehicle by a shaft which is rigidly connected to the support member and rotatably mounted to the vehicle to permit rotation of the support member relative to the vehicle to selectively position one or the other of the skids to engage the ground as the vehicle moves forward with the front wheels off the ground. Stop means are provided for limiting the rotational movement of the support member.

The shaft is also slidably received by the vehicle to permit selective longitudinal positioning of the counterbalance weight relative to the forward and rearward ends of the vehicle such that when the weight is slid to a forward position an insufficient counterbalance force exists to cause the front wheels to raise off the ground as the vehicle moves forward.

Other features and advantages of the invention will become apparent from the following more detailed description, taken in conjunction with the accompanying drawings which illustrate, by way of example, the principles of the invention.

BACKGROUND OF THE INVENTION

The present invention relates generally to self-propelled toy vehicles and, more particularly, to a toy vehicle capable of raising and holding its front wheels off the ground as the vehicle moves forward.

In the past, inexpensive self-propelled toy vehicles have been proven to provide a great deal of enjoyment to children and to be a great commercial success. Frequently, such a toy vehicle uses a windable motor which propels the vehicle in a substantially straight path. To further increase the enjoyment provided, toy vehicles have been manufactured and sold which can be caused to turn left or right as they travel forward. Such a result is often achieved by having front wheels which can be adjustably set to steer the vehicle, or by having a skid automatically positionable to one side or the other of the vehicle, forward of the rear wheels, to lift the front wheels off the ground and cause the vehicle to veer to the left or right as a result of the drag created by the skid.

Other self-propelled toy vehicles have been manufactured and sold with sufficient weight positioned rearward of their rear wheels that when they move forward the front wheels of the vehicles are caused to raise off the ground, doing what has become known as a "wheelstand" or a "wheelie". One such toy vehicle utilizes a windable motor which drives a rear axle to which is rigidly attached a pair of rear wheels, and a weight removably positioned behind the rear axle. This arrangement permits the user to operate the vehicle without the weight, in which case the vehicle travels in a straight path on all four wheels, or to operate the vehicle with the weight attached, in which case the vehicle travels in a straight path on its rear two wheels doing a wheelstand. A pair of spaced-apart identical fixed skids are provided at the rear of the vehicle, but serve only to prevent it from turning over backwards while doing a wheelstand.

It has long been known that a toy vehicle which can be selectively made to operate in a variety of modes and made to do stunts or tricks, without prohibitively increasing the cost of manufacture, is more attactive and enjoyable to the user, and will usually enjoy greater commercial success. Although the aforementioned-vehicle provides two modes of operation, that is, it may be selectively made to move on all four wheels or to do a wheelstand on its rear two wheels, no means are provided to cause the vehicle to depart from its straight path of travel or to give the appearance of doing a stunt or trick. Furthermore, to change from one mode of operation to another requires the removal or attachment of a weight. Removing or attaching a weight everytime the user wants to change modes is inconvenience, and the weight can be easily lost during play.

It will therefore be appreciated that it would be advantageous to provide a toy vehicle that can be selectively made to travel on all wheels or to do a wheelstand, and that can be selectively and controllably made to depart from a straight path of travel while doing a wheelstand and perform a stunt or trick, all without use of a removabe weight or causing a substantial increase in the cost of manufacture. The present invention provides such an advantage, as well as other related advantages.

DETAILED DESCRIPTION

Figure 1:
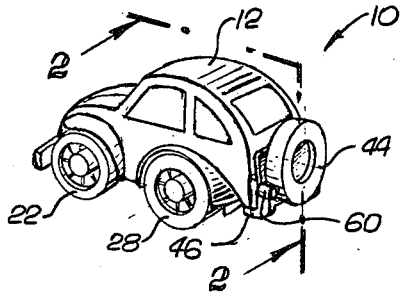
FIG. 1 is a perspective view of a toy vehicle embodying the present invention.
Figure 2:
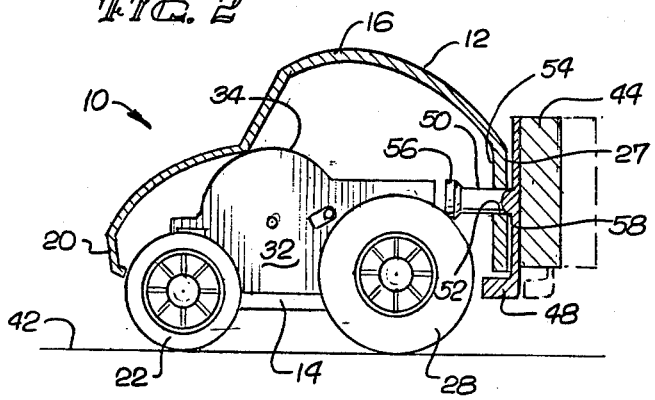
FIG. 2 is an enlarged, partial sectional view of the vehicle shown in FIG. 1, showing two positions for the adjustable counterbalance weight.

As shown in the drawings for purposes of illustration, the present invention is embodied in a toy vehicle, indicated generally by reference numeral 10. The vehicle 10 includes a body 12, which in the illustrated embodiment of the invention comprises a chassis 14 and a shell 16 shaped to depict the exterior of an automobile.

A front axle 18 is positioned toward a forward end 20 of the body 12, and the axle has fixedly attached at its one end a left front wheel 22 and at its other end a right front wheel 24. The front axle 18 is rotatably received by the body 12 to permit free rotation of the axle and attached wheels 22 and 24 relative to the body, with the wheels limiting the lateral movement of the axle and retaining it within the body.

A rear axle 26 is positioned toward a rearward end 27 of the body 12, and the axle has fixedly attached at its one end a left rear wheel 28 and at its other end a right rear wheel 30. A windable motor 32 is mounted within the body 12, and has a motor housing 34 containing the movable motor components. The housing 34 is rigidly secured to the chassis 14.

The rear axle 26 passes through and is rotatably received by the housing 34, and the axle has fixedly attached to it, at a point within the housing, a drive gear 36. The drive gear 36 meshes with a corresponding gear 38 in the motor 32 which is connected through a combination of gears to a flat coil spring 40 that powers the motor. The drive gear 36 has formed as an integral extension thereof, a spacer 39 which serves with the drive gear to limit the lateral movement of the rear axle 26, and to retain the proper alignment of the gears 36 and 38 and the axle within the body 12.

The motor 32 is of a conventional design, utilizing a gear and coil spring combination which produces a high initial speed with a minimum of lateral torque. In the illustrated embodiment of the invention, a pull back motor is shown which is wound by pulling the vehicle backwards with the rear wheels 28 and 30 on the ground 42. As used herein, the term "ground" refers to the surface on which the vehicle 10 is operated, which for the best results is a low friction surface such as a smooth linoleum floor.

In accordance with the invention, the vehicle 10 includes a weighted member 44 attached to the body 12, at its rearward end 27, rearward of the rear axle 26 and rear wheels 28 and 30, which is longitudinally adjustable relative to the body and which may be selectively placed in a rearward position to provide a downwardly directed counterbalance force that, in conjunction with the torque on the rear wheels produced by the motor 32 when it is wound and the vehicle released, causes the front wheels 22 and 24 to raise off the ground and do a wheelstand as the vehicle moves forward. Alternatively, the weighted member 44 may be adjusted to place the member in a forward position where the counterbalance force created is insufficient to cause the front wheels 22 and 24 to raise off the ground as the vehicle moves forward.

In accordance with another aspect of the invention, the weighted member 44 is rotatably adjustable relative to the body 12, and has a pair of laterally spaced-apart left and right skids 46 and 48, respectively, rigidly attached to the member and extending downwardly to engage the ground 42 when the vehicle 10 does a wheelstand and control the path of travel taken by the vehicle. The member 44 may be adjusted to selectively position the left skid 46 to engage the ground 42 at a point adjacent to and rearward of the left rear wheel 28 to the inside of the wheel, and thereby cause the vehicle 10 to spin substantially in a counterclockwise direction while doing a wheelstand. The member 44 may also be adjusted to selectively position the right skid 48 to engage the ground 42 at a point adjacent to and rearward of the right rear wheel 30 to the inside of the wheel, and thereby cause the vehicle 10 to spin substantially in a clockwise direction while doing a wheelstand. Alternatively, the member 44 may be rotated to position the skids 46 and 48 so both engage the ground as the vehicle 10 does a wheelstand, thereby causing the vehicle to travel in a straight path.

More specifically, the weighted member 44 is attached to the body 12 by an elongated shaft 50 rotatably received in an opening 52 in a rearwardly facing portion 54 of the shell 16 of the body 12. The opening 52 is of sufficient size to receive the shaft 50 and permit its rotation therein, but is small enough to provide a sufficient frictional force between the walls of the opening and the shaft that the weighted member 44 will maintain its selected position of rotation during handling and operation of the vehicle 10. In an alternative embodiment of the invention not illustrated, the weighted member 44 may be held in its selected rotational position relative to the body 12 by use of a detent (not shown).

Figure 3:
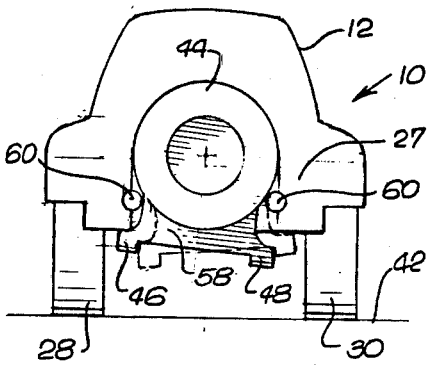
FIG. 3 is an enlarged, rear view of the vehicle shown in FIG., showing two positions for the adjustable skids.
Figure 4:
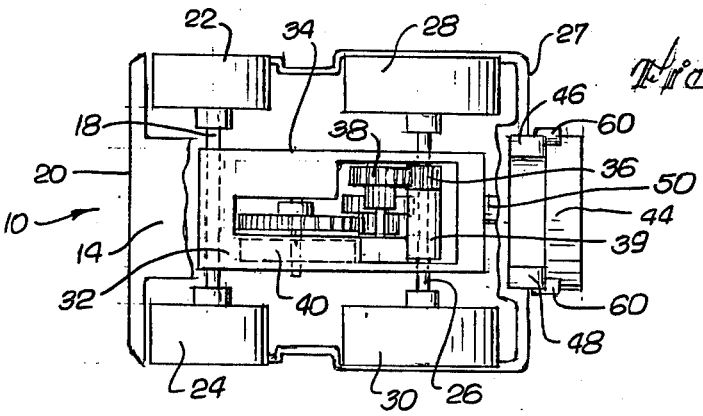
FIG. 4 is an enlarged, fragmentary bottom view of the vehicle shown in FIG. 1.

To provide for longitudinal adjustment of the weighted member 44, the shaft 50 is slidably received in the opening 52, and the shaft is of sufficient length that it may be moved to place the member in a rearward position to provide the counterbalance force needed for a wheelstand or in a forward position where the counterbalance force is insufficient to cause a wheelstand. Sufficient clearance is provided within the body 12 so that the motor 32 does not interfere with the shaft 50 as it is slid inward when placing the member 44 in the forward position. The two positions for the member 44 are illustrated in FIG. 3 with the rearward position shown in phantom. The frictional force between the walls of the opening 52 and the shaft 50 maintains the selected longitudinal position of the weighted member 44 during handling and operation of the vehicle 10.

A stop shoulder 56 on the forward end of the shaft 50, interior to the body 12, limits the longitudinal rearward travel of the shaft and prevents removal of the shaft from the body. The stop shoulder 56 is of sufficient diameter that it will not pass through the opening 52 and also serves as a guide to indicate the rearward position to which the shaft 50 should be slid to place the weighted member 44 in position for a wheelstand.

The weighted member 44 is rigidly connected to the rearward end of the shaft 50. In the illustrated embodiment of the invention, the shaft 50 and skids 46 and 48 comprise an integral unit, with the shaft being connected to the skids through a plate portion 58 to which the weighted member 44 is rigidly attached.

A pair of left and right rotational stops 60 are provided to limit the rotation of the weighted member 44 relative to the body 12, and also serve as guides to indicate the position to which the member should be rotated so the skids 46 and 48 will engage the ground at the position necessary to cause the vehicle to do a spinning wheelstand in the desired direction.

In FIG. 3 the weighted member 44 is shown by solid lines rotated to the preselected position which will cause the right skid 48 to engage the ground 42 and the vehicle 10 to do a clockwise spin when the motor 32 is wound and the vehicle released with the longitudinal position of the member set to the rearward wheelstand position. The position of the member 44 shown in phantom will cause the left skid 46 to engage the ground 42 and the vehicle 10 to do a counterclockwise spin.

Figure 5:
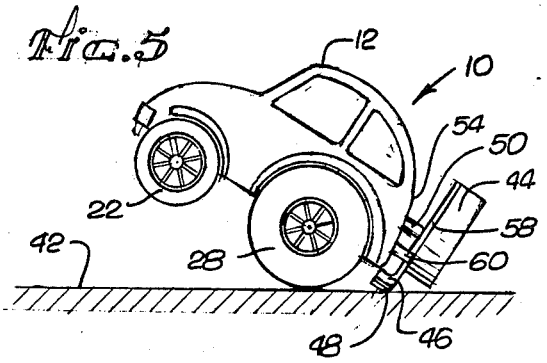
FIG. 5 is an enlarged, side view of the vehicle shown in FIG. 1 doing a wheelstand with the adjustable skid adjusted for a right spin.
Figure 6:
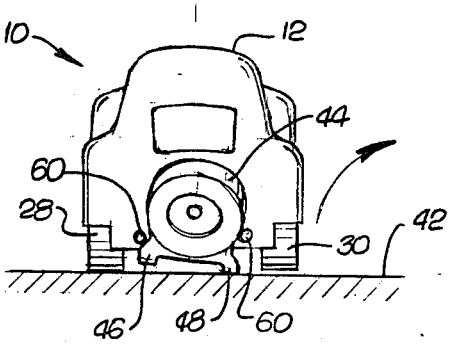
FIG. 6 is a rear view of the vehicle shown in FIG. 5.

The vehicle is shown in FIGS. 5 and 6 doing a wheelstand with the right skid 48 causing a clockwise spin. It is believed that the desired spinning effect results from the skid 48 creating a dynamically unbalanced condition due to the frictional force of the skid dragging on the ground 42 and the torque of the motor 32 lifting only the right rear wheel 30 off of the ground onto the skid 48 while the left rear wheel 28 continues to drive the vehicle. It is noted that the vehicle 10 utilizes a straight rear axle 26 with the motor 32 driving both rear wheels 28 and 30 equally.

The action of the vehicle 10 with the weighted member 44 positioned for a spinning wheelstand is to initially do a tight radius spin about the skid which is engaging the ground; and as the motor winds down, the vehicle begins to move in circles with a gradually increasing radii following a generally spiral path. Finally, when the motor 32 winds down sufficiently that the torque on the rear wheels 28 and 30 in combination with the counter-balance force of the weighted member 44 will no longer keep the vehicle doing a wheelstand, the front wheels 22 and 24 lower to the ground. At that point the vehicle assumes a straight path of travel which it continues until the motor 32 is completely wound down. As a result, the present invention permits the user to select and control the action of the vehicle, and causes the vehicle 10 to travel in an unusual and interesting path which materially adds to the enjoyment of the user.

From the foregoing, it will be appreciated that the invention, as described herein for purposes of illustration, provides a toy vehicle that can be selectively made to do a spinning wheelstand in a direction preselected by the user by adjustment of the position of a weighted member and a pair of skids. It will also be appreciated that, although specific embodiments of the invention have been described herein for purposes of illustration, various modifications may be made without departing from the spirit and scope of the invention. Accordingly, the invention is not limited except as by the appended claims.

I claim:

1. A toy vehicle comprising:

a body;

at least one front wheel positioned toward a forward end of said body;

a pair of spaced-apart rear wheels positioned toward a rearward end of said body;

motor means for driving said rear wheels to propel the vehicle;

a counterbalance weight positioned toward said rearward end of said body, rearward of said rear wheels, to provided a downwardly directed counterbalance force which, in conjunction with the torque on said rear wheels produced by said motor means, causes said at least one front wheel to raise off the ground as the vehicle moves forward; and a support member having attached thereto a pair of spaced-apart skids and being adjustable to selectively position one or the other of said skids to engage the ground at a point located adjacent to and rearward of either one or the other of said rear wheels as the vehicle moves forward with said at least one front wheel off the ground, such that the vehicle may be caused to spin substantially in circles, with the direction of rotation of the spin depending upon the position preselected for said support member.

2. The toy vehicle of claim 1, wherein said support member is attached to said body by a shaft, said shaft being rigidly connected to said member and rotatably mounted to said body to permit rotation of said member relative to said body to selectively position said member for engagement with the ground.

3. The toy vehicle of claim 2, further including stop means for limiting the rotational movement of said support member.

4. A toy vehicle comprising:

a body;

at least one front wheel positioned toward a forward end of said body;

a pair of spaced-apart rear wheels positioned toward a rearward end of said body;

motor means for driving said rear wheels to propel the vehicle; and a weighted member adjustably attached to said body rearward of said rear wheels to provide a downwardly directed counterbalance force which, in conjunction with the torque on said rear wheels produced by said motor means, causes said at least one front wheel to raise off the ground as the vehicle moves forward, said member having rigidly attached thereto a pair of spaced-apart skids and being adjustable to selectively position one or the other of said skids to engage the ground as the vehicle moves forward with said at least one front wheel off the ground, one of said skids being positionable to engage the ground at a point adjacent to and rearward of one of said rear wheels and the other of said skids being positionable to engage the ground at a point adjacent to and rearward of the other of said rear wheels, such that the vehicle may be caused to spin substantially in circles, with the direction of rotation of the spin depending upon the skid preselected to engage the ground.

5. The toy vehicle of claim 4, further including inhibit means for selective longitudinal positioning of said member relative to said forward and rearward ends such that when said member is placed in a forward position an insufficient counterbalance force exists to cause said at least one front wheel to raise off the ground as the vehicle moves forward.

6. The toy vehicle of claim 4, wherein said member is attached to said body by a shaft, said shaft being rigidly connected to said member and rotatably received by said body to permit rotation of said member relative to said body to selectively position said skids for engagement with the ground.

7. The toy vehicle of claim 6, further including stop means for limiting the rotational movement of said member.

8. The toy vehicle of claim 6, wherein said shaft is slidably received by said body to permit selective longitudinal positioning of said member relative to said forward and rearward ends, such that said member may be slid to a forward position where the counterbalance force of said member is insufficient to cause said at least one front wheel to raise off the ground as the vehicle moves forward.

9. A toy vehicle comprising:

a body;

at least one front wheel positioned toward a forward end of said body;

a pair of spaced-apart rear wheels positioned toward a rearward end of said body;

motor means for driving said rear wheels to propel the vehicle and producing sufficient torque on said rear wheels to cause said at least one front wheel to raise off the ground as the vehicle moves forward; and a support member having attached thereto a pair of spaced-apart skids and being adjustable to selectively position one or the other of said skids to engage the ground at a point located adjacent to and rearward of either one or the other of said rear wheels as the vehicle moves forward with said at least front wheels off the ground, such that the vehicle may be caused to spin substantially in circles, with the direction of rotation of the spin depending upon the position preselected for said support member, said support member being rotatably mounted to said body to permit selective rotation of said support member relative to said body for positioning of one or the other of said skids for engagement with the ground.

* * * * *